US012419408B2

(12) United States Patent
Xu et al.

(10) Patent No.: US 12,419,408 B2
(45) Date of Patent: Sep. 23, 2025

(54) MULTI-FACE TOOTHBRUSH

(71) Applicant: Jian Xu, Guangdong (CN)

(72) Inventors: Jian Xu, Guangdong (CN); Hongwen Li, Guangdong (CN)

(73) Assignee: Jian Xu, Guangdong (CN)

( * ) Notice: Subject to any disclaimer, the term of this patent is extended or adjusted under 35 U.S.C. 154(b) by 396 days.

(21) Appl. No.: 18/040,220

(22) PCT Filed: Sep. 24, 2021

(86) PCT No.: PCT/CN2021/120279
§ 371 (c)(1),
(2) Date: Feb. 1, 2023

(87) PCT Pub. No.: WO2022/089110
PCT Pub. Date: May 5, 2022

(65) Prior Publication Data

US 2023/0270241 A1 Aug. 31, 2023

(30) Foreign Application Priority Data

Oct. 26, 2020 (CN) ..... 202011158738.2
Oct. 26, 2020 (CN) ..... 202022414403.4

(51) Int. Cl.
*A46B 5/00* (2006.01)
*A46B 5/02* (2006.01)
(Continued)

(52) U.S. Cl.
CPC ..... *A46B 5/0008* (2013.01); *A46B 5/0095* (2013.01); *A46B 5/026* (2013.01);
(Continued)

(58) Field of Classification Search
CPC ..... A46B 5/0008; A46B 7/023; A46B 7/02; A46B 5/0095; A46B 15/0093;
(Continued)

(56) References Cited

U.S. PATENT DOCUMENTS 2,236,240 A * 3/1941 Lowen ..... A45D 40/18 401/99
4,693,622 A * 9/1987 Booth ..... A46B 11/0027 401/175
(Continued)

FOREIGN PATENT DOCUMENTS

CN 2121916 U * 11/1992 ..... A47L 23/08
CN 201213567 Y 4/2009
(Continued)

OTHER PUBLICATIONS

International Search Report and Written Opinion (ISR-WO), date of mailing Dec. 17, 2021, corresponding to counterpart International Patent Application PCT/CN2021/120279, with English Translation.
(Continued)

*Primary Examiner* — Laura C Guidotti
(74) *Attorney, Agent, or Firm* — Renner, Otto, Boisselle & Sklar, LLP

(57) ABSTRACT

A toothbrush holder is disclosed, the toothbrush holder may include: a handle, where the handle has a top provided with a fixing head, and the fixing head is provided with a plurality of second sliding rails; and a toothbrush bar, where the toothbrush bar is provided with a first sliding rail, and the toothbrush bar has a front end provided with a rotating head, the rotating head is provided with a third sliding rail, the first sliding rail is mutually communicated with the third sliding rail, and a side of the rotating head is rotationally connected with a side of the fixing head so as to enable the second sliding rail to be mutually communicated with the third sliding rail. In addition, a multi-face toothbrush having a plurality of toothbrush heads is disclosed, which achieves the effect of one toothbrush holder having a plurality of toothbrush heads.

9 Claims, 3 Drawing Sheets

(51) Int. Cl.
*A46B 7/04* (2006.01)
*A46B 9/04* (2006.01)

(52) U.S. Cl.
CPC ..... *A46B 7/044* (2013.01); *A46B 9/04* (2013.01); *A46B 5/002* (2013.01); *A46B 2200/1066* (2013.01)

(58) Field of Classification Search
CPC ..... A46B 15/0095; A46B 5/026; A46B 7/044; A45D 40/24; A45D 40/264; A45D 40/262; B43K 24/12
USPC ..... 401/29–33, 108, 112
See application file for complete search history.

(56) References Cited

U.S. PATENT DOCUMENTS

| | | | | | |
|---|---|---|---|---|---|
| 5,109,877 | A * | 5/1992 | Takeda | A46B 7/023 132/218 |
| 2015/0305482 | A1* | 10/2015 | Tran | A61C 17/3481 15/22.1 |

FOREIGN PATENT DOCUMENTS

| | | | | | |
|---|---|---|---|---|---|
| CN | 201847074 | U | | 6/2011 | |
| CN | 103479061 | A | | 1/2014 | |
| CN | 205729552 | U | | 11/2016 | |
| CN | 209058246 | U | | 7/2019 | |
| CN | 110448035 | A | | 11/2019 | |
| CN | 112220192 | A | | 1/2021 | |
| CN | 213908993 | U | | 8/2021 | |
| DE | 20013158 | U1 | | 1/2002 | |
| JP | H11290132 | A | * | 10/1999 | A46B 15/00 |
| KR | 20170082725 | A | | 7/2017 | |

OTHER PUBLICATIONS

Chinese Office Action corresponding to counterpart Chinese patent application No. CN202011158738.2 dated Dec. 17, 2023, with English translation.

* cited by examiner

MULTI-FACE TOOTHBRUSH

CROSS-REFERENCE TO RELATED APPLICATIONS

This application is a national stage filing under 35 U.S.C. § 371 of international application number PCT/CN2021/120279, filed Sep. 24, 2021, which claims priority to Chinese patent application No. 202011158738.2 and No. 202022414403.4, both filed Oct. 26, 2020. The contents of these applications are incorporated herein by reference in their entirety.

TECHNICAL FIELD

The present disclosure relates to the technical field of clinical medical oral health equipment, and in particular to a toothbrush holder and a multi-face toothbrush.

BACKGROUND

Keeping the oral cavity clean is an important condition for preventing dental disease. We brush our teeth everyday is for clearing dental plaque on teeth, so as to prevent various oral diseases such as tooth decay and gingivitis. At present, most toothbrushes employ a design of single toothbrush head, which cannot simultaneously meet the demands on thorough cleaning of teeth at different positions in the oral cavity; and the toothbrush head of most multi-head toothbrushes can only be replaced after being disassembled, and thus the purpose of rapidly replacing the toothbrush heads cannot be achieved.

SUMMARY

The present disclosure aims at solving at least one of the technical problems in the existing technology. For this reason, the present disclosure provides a toothbrush holder, which is of a simple structure and facilitates the achievement of a design of a toothbrush having a plurality of toothbrush heads.

The present disclosure further provides a multi-face toothbrush with the above toothbrush holder, for which the toothbrush heads can be rapidly replaced.

The toothbrush holder according to the embodiment in the first aspect of the present disclosure may include a handle, where the handle has a top provided with a fixing head, and the fixing head is provided with a plurality of second sliding rails; and a toothbrush bar, where the toothbrush bar is provided with a first sliding rail, and the toothbrush bar has a front end provided with a rotating head, the rotating head is provided with a third sliding rail, the first sliding rail is mutually communicated with the third sliding rail, and a side of the rotating head is rotationally connected with a side of the fixing head so as to enable the second sliding rails to be mutually communicated with the third sliding rail.

The toothbrush holder according to the embodiments of the present disclosure at least has the following beneficial effects: the toothbrush holder has a handle configured to be hold by a hand; the first sliding rail is mutually communicated with the third sliding rail, and the rotating head is rotationally connected with the fixing head, so that one of the second sliding rails can be mutually communicated with the third sliding rail; and another second sliding rail can be switched and communicated with the third sliding rail by rotating the rotating head, so that the second sliding rails are rapidly switched, and the design of the toothbrush having a plurality of toothbrush heads is conveniently achieved.

According to some embodiments of the present disclosure, the side of the fixing head connected to the rotating head is provided with an inserting head; and the side of the rotating head connected to the fixing head is provided with an inserting hole matched with the inserting head.

According to some embodiments of the present disclosure, the inserting head is provided with a plurality of snaps; the inserting hole is provided with a plurality of clamping grooves inside; the snaps and the clamping grooves are in one-to-one correspondence and can be mutually buckled through rotation; and after buckling, one of the second sliding rails is communicated with the third sliding rail.

According to some embodiments of the present disclosure, the handle is provided with anti-slip protrusions.

According to some embodiments of the present disclosure, the handle is arranged as a cylinder.

The multi-face toothbrush according to the embodiment of the second aspect of the present disclosure may include the toothbrush holder according to the embodiment of the first aspect of the present disclosure and a plurality of toothbrush heads, where the plurality of toothbrush heads are slidably mounted on the plurality of second sliding rails in one-to-one correspondence, and one of the toothbrush heads can slide to the end of the toothbrush bar through the second sliding rail, the third sliding rail and the first sliding rail.

The multi-face toothbrush according to the embodiments of the present disclosure at least has the following beneficial effects: the toothbrush holder is provided with a plurality of toothbrush heads; the plurality of toothbrush heads are slidably mounted on the plurality of second sliding rails in one-to-one correspondence, and one of the toothbrush heads slides to the end of the toothbrush bar through the second sliding rail, the third sliding rail and the first sliding rail; and another second sliding rail can be switched by rotating the rotating head, so that the another toothbrush head slides to the end of the toothbrush bar, so as to achieve the purpose of rapidly replacing toothbrush head.

According to some embodiments of the present disclosure, the end of the toothbrush bar is provided with a limiting portion; two ends of the limiting portion are connected with two rail ends of the first sliding rail respectively; and the limiting portion is configured to limit the toothbrush heads from sliding out of the ends of the first sliding rail.

According to some embodiments of the present disclosure, the toothbrush heads may include four different types of toothbrush heads used for grinding teeth, brushing canine teeth, brushing incisor teeth and brushing gums respectively.

According to some embodiments of the present disclosure, the toothbrush heads are provided with labels for indicating functions of the toothbrush heads.

According to some embodiments of the present disclosure, a toothbrush cover covers the toothbrush heads.

Additional aspects and advantages of the present disclosure will be given in part in the following description, become apparent in part in the following description or be appreciated in practicing of the present disclosure.

BRIEF DESCRIPTION OF DRAWINGS

The present disclosure will be further described below in detail in combination with the accompanying drawings and the embodiments, wherein.

REFERENCE NUMERALS

Figure 1:
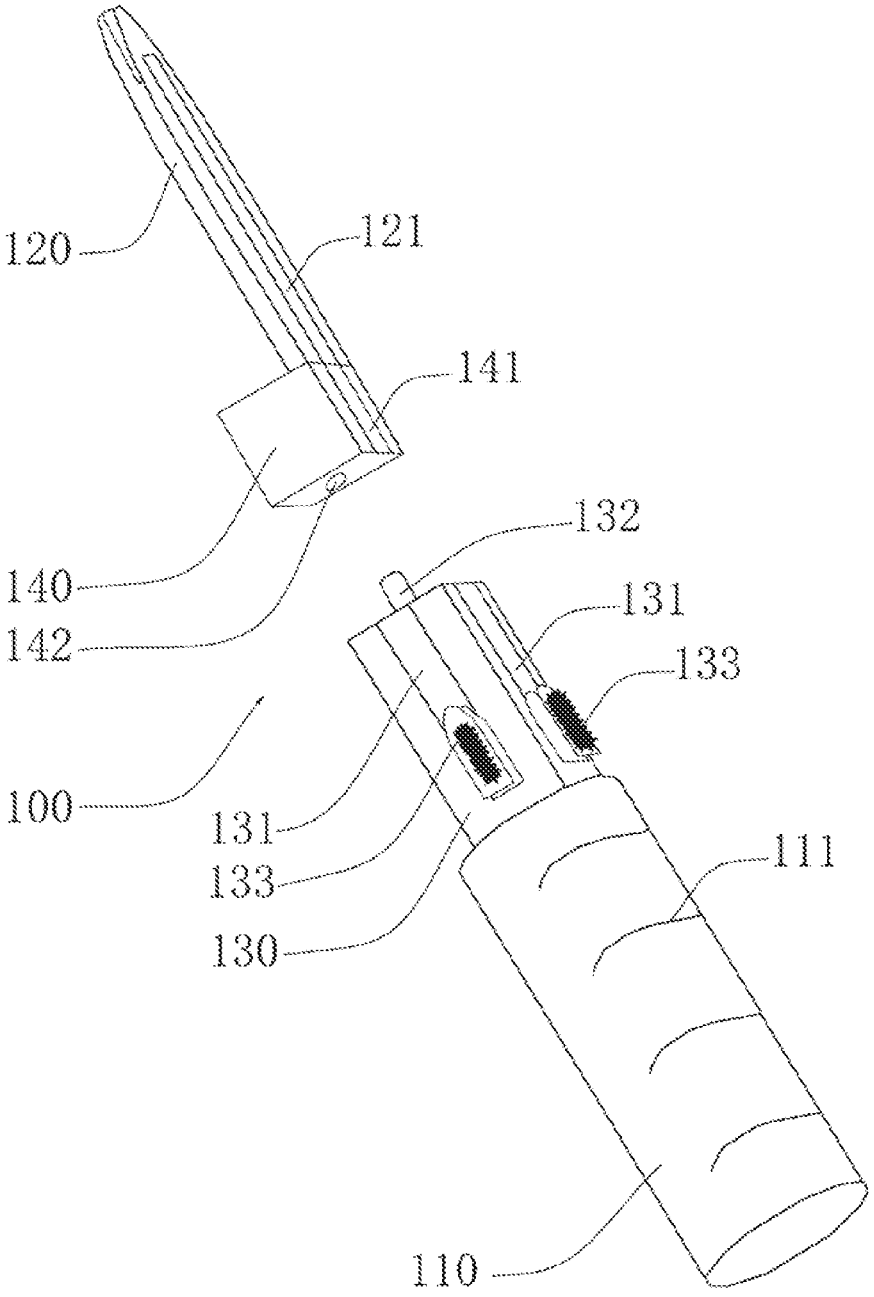
FIG. 1 is an exploded schematic diagram according to the embodiments of the present disclosure.

Reference numerals: multi-face toothbrush 100, handle 110, anti-slip protrusion 111, toothbrush bar 120, first sliding rail 121, fixing head 130, second sliding rail 131, inserting head 132, rotating head 140, third sliding rail 141, inserting hole 142, toothbrush head 133.

DETAILED DESCRIPTION

The following describes the embodiments of the present disclosure in detail. The examples of the embodiments are illustrated in the drawings, wherein the same or similar reference numerals refer to the same or similar elements or elements with the same or similar functions throughout the drawings. The following embodiments described with reference to the drawings are exemplary and serve only to explain the present disclosure, and should not be construed as limiting the present disclosure.

In description of the present disclosure, it should be understood that, referring to orientation description, the instructed orientation or positional relationships, for example, upper, lower, front, rear, left, right, etc., are based on the orientation or positional relationships shown in the drawings, merely for facilitating the description of the present disclosure and simplification for the description, rather than indicating or implying that the device or element referred to must have a specific orientation and be constructed and operated in a specific orientation, which, therefore, cannot be construed as limiting the present disclosure.

In the description of the present disclosure, "a plurality of" refers to "one or more", "multiple" refers to "two or more", "greater than, less than, over and the like are understood as excluding this number, and "above, below, within and the like" are understood as including this number. If described, first and second are only for the purpose of distinguishing technical features, and not to be construed as indicating or implying relative importance or implicitly indicating the number of technical features indicated or implicitly indicating the sequence of technical features.

In the description of the present disclosure, unless explicitly defined otherwise, the terms "providing, mounting, connecting and the like" should be understood broadly, and a person skilled in the art can reasonably determine the specific meaning of the above words in the present disclosure combined with the specific content of the technical solution.

In the description of the present disclosure, description of reference terms such as "one embodiment", "some embodiments", "exemplary embodiments", "examples", "specific example" or "some examples" implies that specific characteristics, structures, materials or features described in combination with these embodiments or examples are included in at least one embodiment or example of the present disclosure. In the present specification, the schematic expression of the above terms does not necessarily refer to the same embodiment or example. Moreover, the specific characteristics, structures, materials or features described in any one or more embodiments or examples can be combined in a suitable manner.

A toothbrush holder and a multi-face toothbrush 100 according to the embodiments of the present disclosure are described in reference with FIGS. 1-3 below.

As shown in FIG. 1, the toothbrush holder according to the embodiments of the present disclosure includes a handle 110 and a toothbrush bar 120.

The handle 110 has a top provided with a fixing head 130, and the fixing head 130 is provided with a plurality of second sliding rails 131; and the toothbrush bar 120 is provided with a first sliding rail 121, and the toothbrush bar 120 has a front end provided with a rotating head 140, the rotating head 140 is provided with a third sliding rail 141, the first sliding rail 121 is mutually communicated with the third sliding rail 141, and a side of the rotating head 140 is rotationally connected with a side of the fixing head 130 so as to enable the second sliding rails 131 to be mutually communicated with the third sliding rail 141.

Specifically, the toothbrush holder is provided with a handle 110 used to be hold by a hand, the fixing head 130 is provided with a plurality of second sliding rails 131, the toothbrush bar 120 is provided with the first sliding rail 121, the rotating head 140 is provided with the third sliding rail 141, the first sliding rail 121 is mutually communicated with the third sliding rail 141, and the third sliding rail 141 is rotationally connected with the fixing head 130, so that the second sliding rails 131 can be communicated with the third sliding rail 141. The second sliding rails 131 can be switched by rotating the rotating head 140, so that different second sliding rail 131 is communicated with the third sliding rail 141 to form a toothbrush holder capable of rapidly switching the second sliding rails 131 and facilitating the achievement of a design of the toothbrush having a plurality of toothbrush heads 133.

Referring to FIG. 1, in some embodiments of the present disclosure, the side of the fixing head 130 connected to the rotating head 140 is provided with an inserting head 132; and the side of the rotating head 140 connected to the fixing head 130 is provided with an inserting hole 142 matched with the inserting head 132. Specifically, the inserting head 132 is inserted into the inserting hole 142, and the rotating head 140 can rotate on the fixing head 130; and the inserting head can further be arranged on a side of the rotating head 140 connected with the fixing head 130, and the inserting hole matched with the inserting head can further be formed on a side of the fixing head 130 connected with the rotating head 140.

In some embodiments of the present disclosure, the inserting head 132 is provided with a plurality of snaps (not shown in the drawings); the inserting hole 142 is provided with a plurality of clamping grooves (not shown in the drawings) inside; the snaps and the clamping grooves are in one-to-one correspondence and can be mutually buckled through rotation; and after buckling, one of the second sliding rails 131 is communicated with the third sliding rail 141. Specifically, the inserting head 132 is provided with a plurality of snaps, the inserting hole 142 is provided with a plurality of clamping grooves inside, the snaps and the clamping grooves are in one-to-one correspondence and can be mutually buckled through rotation; when the rotating head 140 rotates, the third sliding rail 141 can be communicated with one of the second sliding rails 131, so as to prevent the situation that the second sliding rail 131 is not aligned with the third sliding rail 141 and the toothbrush head 133 cannot slide to the end of the toothbrush bar 120; and when the third sliding rail 141 is communicated with one of the second sliding rails 131, a clicking sound will be issued to remind a user that the third sliding rail 141 has already communicated with the second sliding rail 131.

Referring to FIG. 1, in some embodiments of the present disclosure, the handle 110 is provided with anti-slip protrusions 111. Specifically, the anti-slip protrusions 111 are provided to strengthen friction between the hand and the handle 110, and thus the toothbrush holder is not easy to drop off during use.

Figure 2:
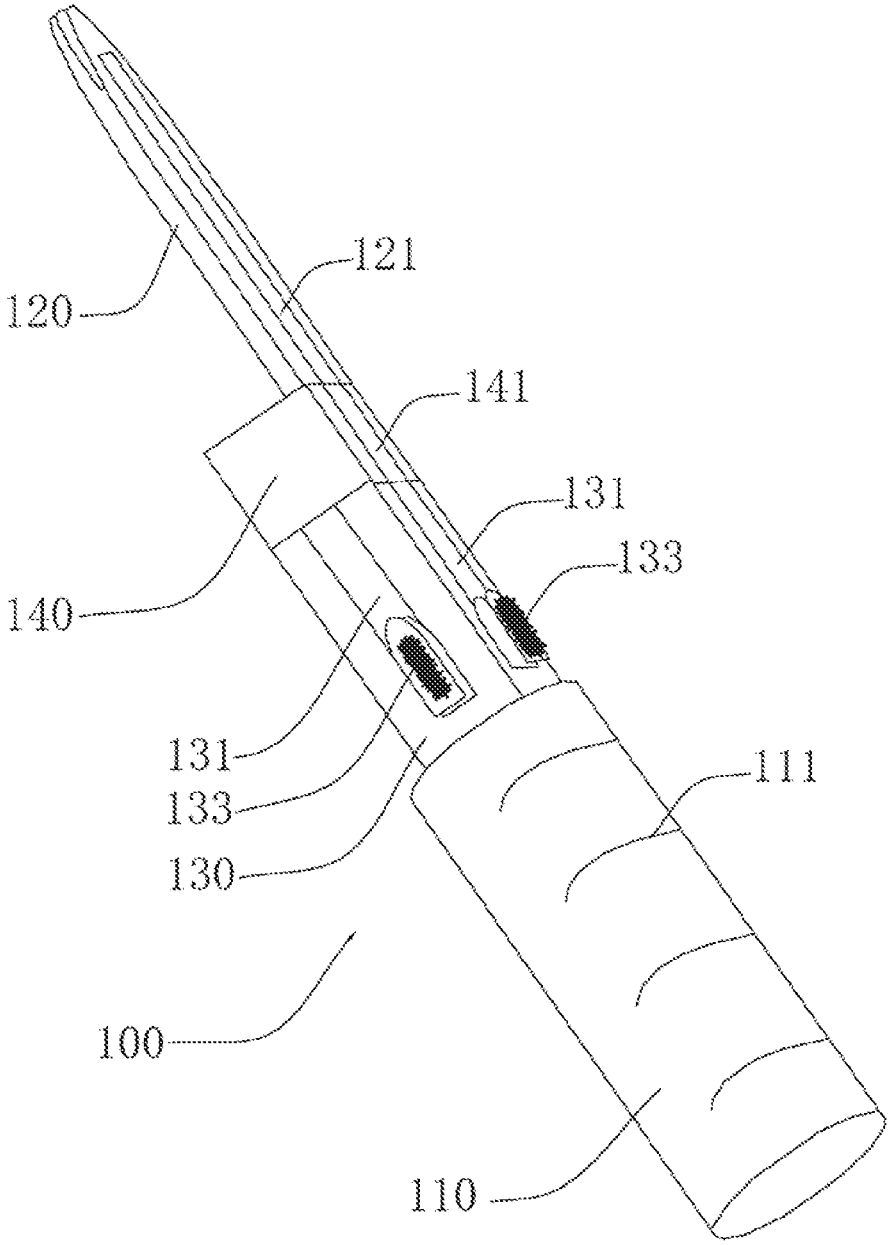
FIG. 2 is a structural schematic diagram according to the embodiments of the present disclosure.
Figure 3:
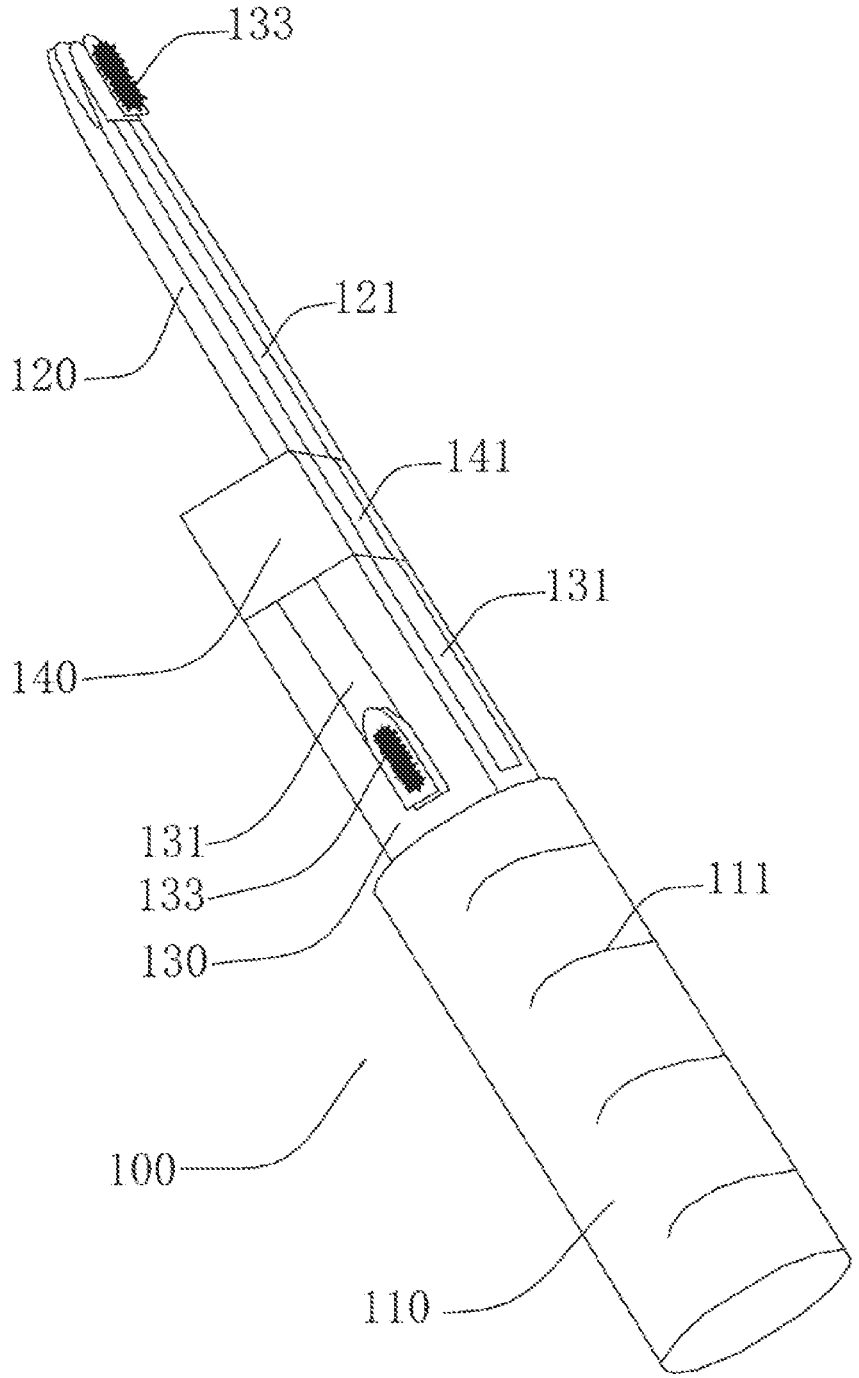
FIG. 3 is a schematic diagram of a state when a toothbrush head slides to the end of a toothbrush bar according to the embodiments of the present disclosure.

Referring to FIG. 2, in some embodiments of the present disclosure, the handle 110 is a cylinder. Specifically, by arranging the handle 110 as the cylinder, the multi-face toothbrush 100 can be vertically and smoothly placed on a table, which is more sanitary compared with the existing manner that the toothbrush is directly put in a washing cup, so that the pollution caused by a contact between the toothbrush head 133 and the washing cup can be prevented. The handle 110 can further be arranged in a shape adapting to a hand grip to obtain a more comfortable grip.

The multi-face toothbrush 100 according to the embodiment in the second aspect of the present disclosure includes a toothbrush holder and toothbrush heads 133.

A plurality of toothbrush heads 133 are provided and are slidably mounted on a plurality of second sliding rails 131 in one-to-one correspondence; and one of the toothbrush heads 133 can slide to the end of the toothbrush bar 120 through the second sliding rail 131, the third sliding rail 141 and the first sliding rail 121.

Specifically, a plurality of toothbrush heads 133 are provided and are slidably mounted on a plurality of second sliding rails 131 in one-to-one correspondence to achieve the function of a toothbrush holder with a plurality of toothbrush heads 133; the toothbrush head 133 slides to the end of the toothbrush bar 120 through one second sliding rail 131, the third sliding rail 141 and the first sliding rail 121; and another second sliding rail 131 can be switched by rotating the rotating head 140, so that the another toothbrush head 133 on the another second sliding rail 131 slides to the end of the toothbrush bar 120, so as to achieve the purpose of rapidly replacing the toothbrush head 133.

In some embodiments of the present disclosure, a limiting portion (not shown in the drawings) is arranged at the end of the toothbrush bar 120; two ends of the limiting portion are connected with two rail ends of the first sliding rail 121 respectively; and the limiting portion is configured to limit the toothbrush heads 133 from sliding out of the ends of the first sliding rail 121. Specifically, the end of the toothbrush bar 120 is provided with a limiting portion, and the two ends of the limiting portion are connected with the two rail ends of the first sliding rail 121 respectively, so that one of the toothbrush heads 133 will not slide out of the first sliding rail 121 to be lost when sliding to the end of the toothbrush bar 120; and a clamping groove can further be formed at the end of the toothbrush bar 120, so that one of the toothbrush heads 133 is automatically clamped when sliding to the end of the toothbrush bar 120 to prevent same from moving in the tooth brushing process.

In some embodiments of the present disclosure, the toothbrush heads include four different types of toothbrush heads 133 used for grinding teeth, brushing canine teeth, brushing incisor teeth and brushing gums respectively. Specifically, the four different types of toothbrush heads 133 are arranged for cleaning different teeth in an oral cavity of a human, and thus the demands on cleaning the teeth at different positions in the oral cavity are met.

In some embodiments of the present disclosure, the toothbrush heads 133 are provided with labels (not shown in the drawings) for indicating functions of the toothbrush heads 133. Specifically, the toothbrush heads 133 are provided with labels for indicating functions of the toothbrush heads 133, so that the user can rapidly find the toothbrush head 133 with the corresponding function and specifically brushes the teeth.

In some embodiments of the present disclosure, the multi-face toothbrush 100 includes a toothbrush cover (not shown in the drawings), which covers the toothbrush heads 133. Specifically, by providing the toothbrush cover for the toothbrush heads 133, the sealing effect can be exerted; and when not in use, the toothbrush head 133 is covered with the toothbrush cover for protection, thereby preventing the toothbrush head 133 from being polluted by pollutants in the air.

The above makes detailed description on the embodiments of the present disclosure in combination with the drawings, but the present disclosure is not limited to the above embodiments. Various variations can further be made without departing from the scope of the present disclosure within the knowledge range possessed by one of ordinary skill in the art. In addition, the embodiments of the present disclosure and the features in the embodiments can be combined with other another without conflict.

What is claimed is:

1. A toothbrush holder, comprising:

a handle, wherein the handle has a top provided with a fixing head, and the fixing head is provided with a plurality of second sliding rails; and a toothbrush bar, wherein the toothbrush bar is provided with a first sliding rail, and the toothbrush bar has a front end provided with a rotating head, the rotating head is provided with a third sliding rail, the first sliding rail is mutually communicated with the third sliding rail, and a side of the rotating head is rotationally connected with a side of the fixing head so as to enable the second sliding rails to be mutually communicated with the third sliding rail;

wherein the side of the fixing head connected to the rotating head is provided with an inserting head; and the side of the rotating head connected to the fixing head is provided with an inserting hole matched with the inserting head.

2. The toothbrush holder according to claim 1, wherein the inserting head is provided with a plurality of snaps; and the inserting hole is provided with a plurality of clamping grooves inside; the snaps and the clamping grooves are in one-to-one correspondence and capable of being mutually buckled through rotation; and after buckling, one of the second sliding rails is communicated with the third sliding rail.

3. The toothbrush holder according to claim 1, wherein the handle is provided with anti-slip protrusions.

4. The toothbrush holder according to claim 1, wherein the handle is arranged as a cylinder.

5. A multi-face toothbrush, comprising the toothbrush holder according to claim 1 and a plurality of toothbrush heads, wherein the plurality of toothbrush heads are slidably mounted on the plurality of second sliding rails in one-to-one correspondence, and the toothbrush heads are capable of sliding to the end of the toothbrush bar through the second sliding rail, the third sliding rail and the first sliding rail.

6. The multi-face toothbrush according to claim 5, wherein the end of the toothbrush bar is provided with a limiting portion; two ends of the limiting portion are connected with two rail ends of the first sliding rail respectively;

and the limiting portion is configured to limit the toothbrush heads from sliding out of the ends of the first sliding rail.

7. The multi-face toothbrush according to claim 5, wherein the toothbrush heads comprise four different types of toothbrush heads used for grinding teeth, brushing canine teeth, brushing incisor teeth and brushing gums respectively.

8. The multi-face toothbrush according to claim 5, wherein the toothbrush heads are provided with labels for indicating functions of the toothbrush heads.

9. The multi-face toothbrush according to claim 5, further comprising a toothbrush cover that covers the toothbrush heads.

* * * * *